US005398525A

United States Patent [19]

Kennedy

[11] Patent Number: 5,398,525

[45] Date of Patent: Mar. 21, 1995

[54] JEWELRY WITH ROD LIKE GEMSTONES AND METHOD OF MAKING SAME

[76] Inventor: John J. Kennedy, 41D Church St., Easthampton, Mass. 01027

[21] Appl. No.: 134,118

[22] Filed: Oct. 8, 1993

[51] Int. Cl.[6] ..... A44C 17/02

[52] U.S. Cl. ..... 63/28; 63/26

[58] Field of Search ..... 63/26, 28, 15, 29

[56] References Cited

U.S. PATENT DOCUMENTS

| | | | |
|---|---|---|---|
| 843,006 | 2/1907 | Dover . | |
| 1,328,948 | 1/1920 | Dover . | |
| 1,421,339 | 1/1922 | Zalowitz . | |
| 1,539,940 | 1/1925 | Gaschke . | |
| 1,654,335 | 12/1927 | Lindroth . | |
| 2,261,958 | 11/1941 | Burri . | |
| 2,749,597 | 6/1956 | Fus . | |
| 3,483,716 | 12/1969 | Stenzler | 63/28 |
| 4,796,442 | 1/1989 | Sarconya . | |
| 4,821,533 | 4/1989 | Bonnefoy . | |
| 5,022,238 | 6/1991 | German | 63/26 |
| 5,036,682 | 8/1991 | Kennedy . | |
| 5,099,660 | 3/1992 | Dostourian | 63/28 |
| 5,188,679 | 2/1993 | Kretchmer | 63/26 |

FOREIGN PATENT DOCUMENTS

| | | | |
|---|---|---|---|
| 597629 | 11/1925 | France . | |
| 43440 | 6/1934 | France . | |
| 925465 | 9/1947 | France | 63/29.1 |
| 1437648 | 3/1966 | France . | |

OTHER PUBLICATIONS

Deutsche Goldschmiede-Zeitung (German Goldsmith Newspaper), Oct. 1960, pp. 366 & 556.

*Primary Examiner*—Michael J. Milano

[57] ABSTRACT

An article of jewelry includes a metal finding having an outer surface with at least one recess therein. The recess is bounded in part by side walls extending along opposite sides of the finding, and each of the side walls has at least one aperture therein. An elongated rod-like gemstone is disposed in the recess with its end portions firmly seated in the apertures to retain the gemstone securely within the finding. The gemstone and apertures are cooperatively configured and dimensioned to expose at least a portion of at least one end face of the gemstone.

17 Claims, 4 Drawing Sheets

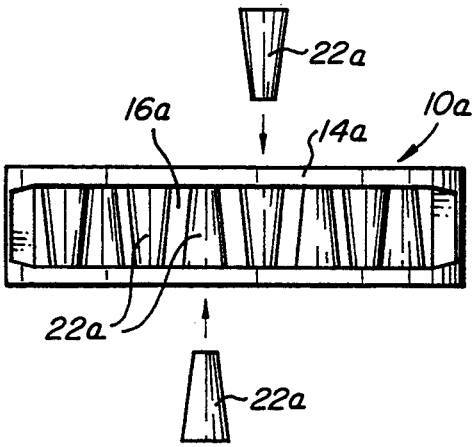
FIG. 10
FIG. 11
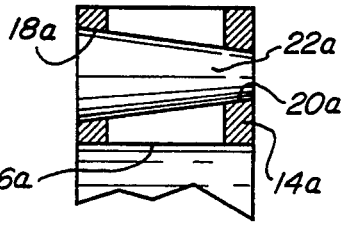
FIG. 8
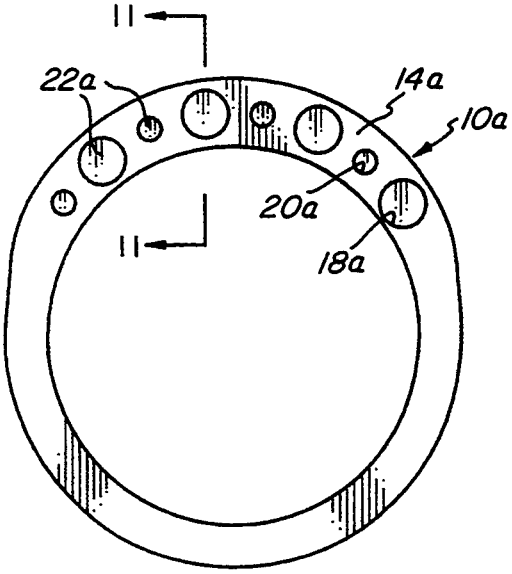
FIG. 9
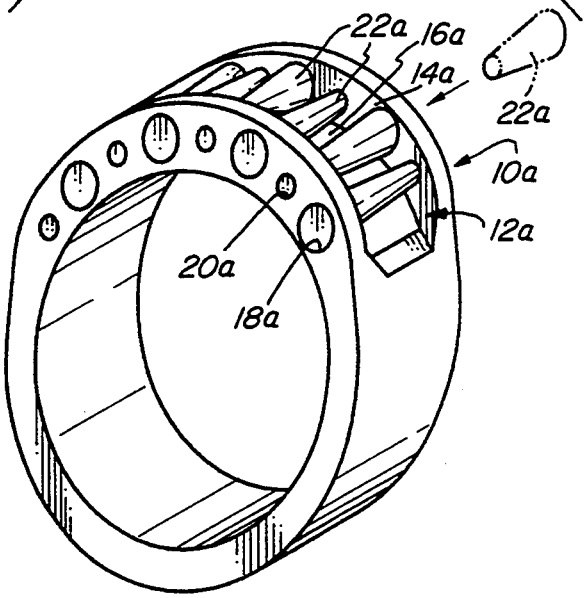

FIG. 14
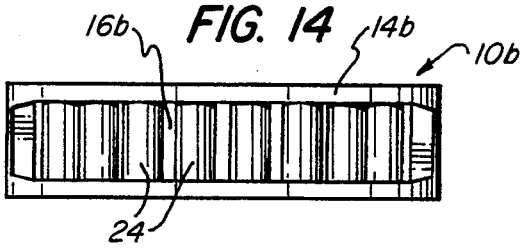
FIG. 15
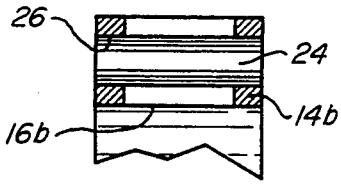
FIG. 12
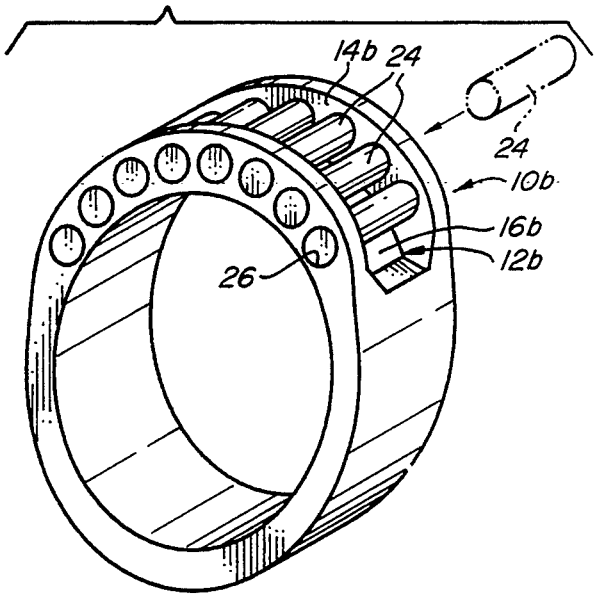
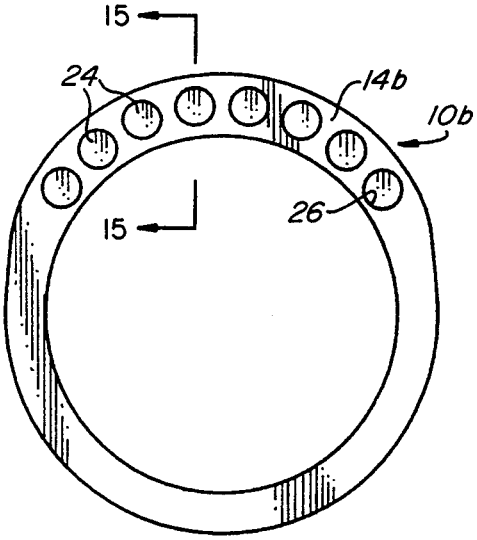
FIG. 13
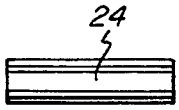
FIG. 17
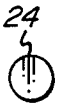
FIG. 16

FIG. 20
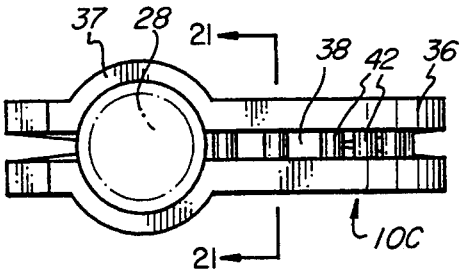
FIG. 21
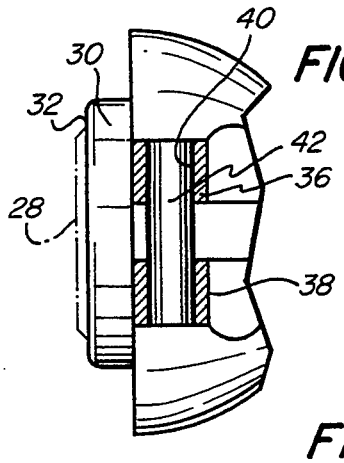
FIG. 18
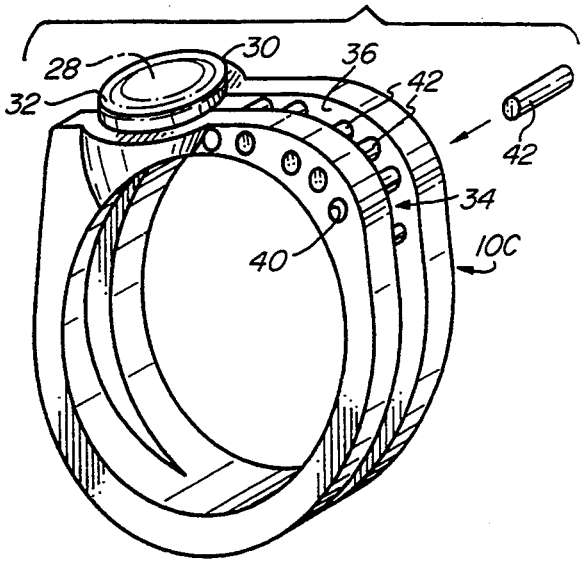
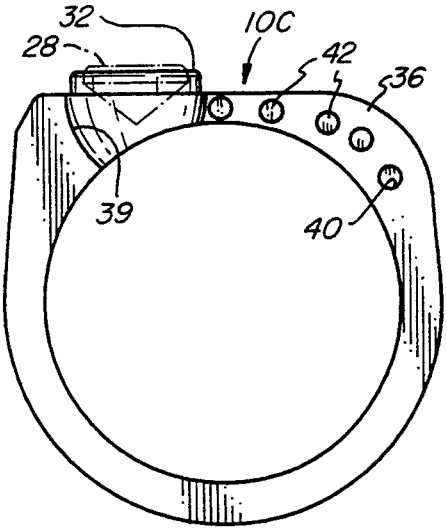
FIG. 19

JEWELRY WITH ROD LIKE GEMSTONES AND METHOD OF MAKING SAME

BACKGROUND OF THE INVENTION

The present invention relates to jewelry, and, more particularly, to jewelry using small gemstones set in metallic findings.

For many centuries, skilled artisans have been producing jewelry by setting gemstones in findings of various metals, and such gemstones have been of various configurations and sizes. As is well known, highly attractive and unique jewelry can be produced by using smaller gemstones, by modifying the patterns in which they appear within the finding, and by varying the sizes of the gemstones in a given finding. Although gemstones have been cut in various shapes, generally they are faceted and highly polished in order to provide a high degree of brilliance.

In United States Letters Pat. No. 5,036,682 granted Aug. 6, 1991, there is disclosed jewelry which makes use of small cylindrical gemstones disposed within a recess to provide an aesthetically pleasing, unique jewelry item. Although the jewelry permits viewing of the length of the gemstones, their ends are covered and light rays cannot enter therethrough.

It is an object of the present invention to provide novel jewelry which permits light to be transmitted through rod-like gemstones as well as to be reflected by them.

It is also an object to provide such a jewelry item which permits such gemstones to be mounted in spaced relationship.

It is a further object to provide such jewelry which may be fabricated readily and in which the gemstones are firmly engaged.

Still another object is to provide a novel method for making jewelry using small rod-like gemstones which method lends itself to wide variation in the nature of the findings and the appearance of the ultimate jewelry items.

SUMMARY OF THE INVENTION

It has now been found that the foregoing and related objects may be readily attained in an article of jewelry which has a metal finding having an outer surface with at least one recess therein. The recess is bounded in part by side walls extending along opposite sides of the finding, and each of the side walls has at least one aperture therein. An elongated rod-like gemstone is disposed in the recess with its end portions firmly seated in the apertures to retain the gemstone securely within the finding. The gemstone and apertures are cooperatively configured and dimensioned to expose at least a portion of at least one end face of the gemstone.

Preferably, each of the side walls is provided with a plurality of apertures aligned with the apertures in the other of the side walls, and a plurality of gemstones are disposed in the recess and have their end portions seated in the apertures.

Generally, the gemstone is of a generally cylindrical configuration and has a diameter of not more than 2.2 mm and a length to diameter ratio of at least 2:1.

In its most common embodiment, the metal finding is a ring having the recess extending about a portion of its circumference, and the gemstone and apertures are cooperatively configured and dimensioned to expose at least a portion of both end faces of the gemstone. Bonding means is included in the apertures to retain the gemstone securely within the recess.

In making the jewelry, a metallic jewelry finding is formed and an elongated rod-like gemstone is inserted through one of the apertures and extends across the recess. Its end portions are seated in the apertures and secured in the apertures so as to expose at least a portion of at least one end face of the gemstone at one side of the finding.

Desirably, portions of the gemstone projecting beyond the outer surfaces of the side walls are ground to render the end faces flush with the outer surfaces.

A bonding agent may be placed in the apertures to secure the gemstone in the apertures. The securing step may be effected by deforming a portion of the sidewalls adjacent the apertures to firmly engage the gemstone therein.

BRIEF DESCRIPTION OF THE DRAWINGS

FIG. 8 is a perspective view of another embodiment of a ring of the present invention, drawn to an enlarged scale, and showing one of the gemstones prior to insertion;

FIG. 9 is a front elevational view thereof;

FIG. 10 is a top view thereof, showing two of the gemstones prior to insertion;

FIG. 11 is a fragmentary and enlarged cross sectional view thereof along the line 11—11 of FIG. 9;

FIG. 12 is a perspective view of still another embodiment of a ring of the present invention, drawn to an enlarged scale, and showing one of the gemstones prior to insertion;

FIG. 13 is a front elevational view thereof;

FIG. 14 is a top view thereof;

FIG. 15 is a fragmentary and enlarged cross sectional view thereof along the line 15—15 of FIG. 13;

FIG. 16 is an end elevational view of one of the gemstones;

FIG. 17 is a side elevational view thereof;

FIG. 18 is a perspective view of a further embodiment of a ring of the present invention, drawn to an enlarged scale, and showing one of the gemstones prior to insertion;

FIG. 19 is a front elevational view thereof;

FIG. 20 is a top view thereof; and

FIG. 21 is a fragmentary cross sectional view thereof along the line 21—21 of FIG. 20;

DETAILED DESCRIPTION OF THE PREFERRED EMBODIMENTS

Figure 4:
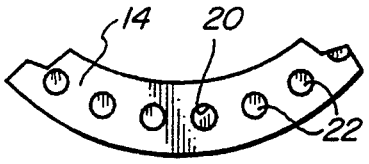
FIG. 4 is a fragmentary rear elevational view thereof.
Figure 3:
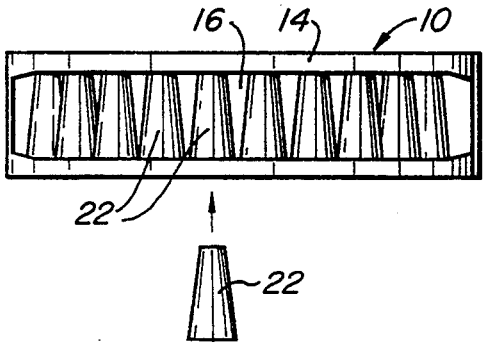
FIG. 3 is a top view thereof, again showing one of the gemstones prior to insertion.
Figure 5:
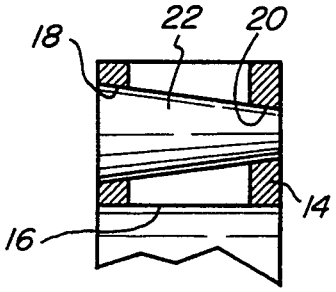
FIG. 5 is a fragmentary and enlarged cross sectional view thereof along the line 5—5 of FIG. 2.
Figure 2:
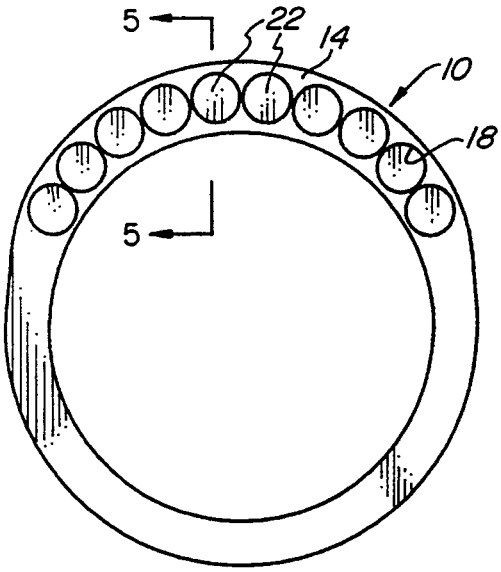
FIG. 2 is a front elevational view thereof.

Turning first to FIGS. 1–7, a ring embodying the present invention is illustrated therein as having a metallic finding generally designated by the numeral 10. A recess generally designated by the numeral 12 is formed in the periphery of the finding 10, and in the recess 12 is disposed a multiplicity of generally conical shaped gemstones 22.

Figure 1:
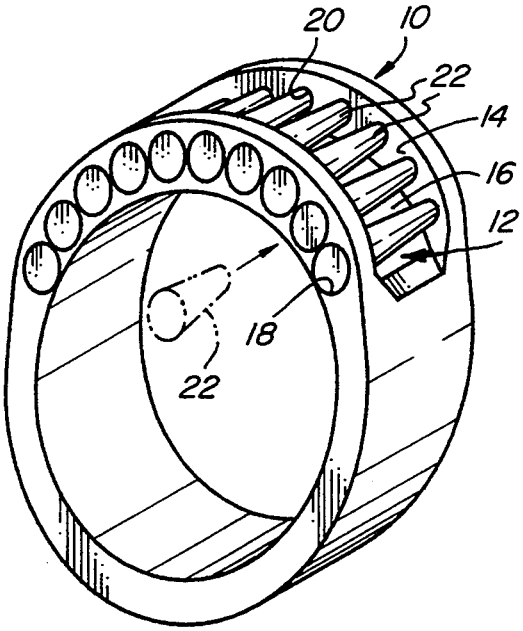
FIG. 1 is a perspective view of a ring embodying the present invention, drawn to an enlarged scale, and showing in phantom line one of the gemstones prior to insertion.
Figure 7:
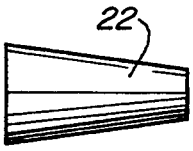
FIG. 7 is a side elevational view thereof.
Figure 6:
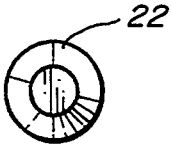
FIG. 6 is an end elevational view of one of the gemstones.

As best seen in FIG. 1, the recess 12 has a pair of side walls 14 and a base wall 16. In one of the side walls 14 is a multiplicity of large apertures 18 each having a circumference and tapering cross section corresponding to the circumference and taper of the large end of the gemstones 22. In the other of the side walls 14 is a multiplicity of small apertures 20 each having a circumference and tapering cross section corresponding to the circumference and taper of the small end of the gemstones 22.

The gemstones 22 are mounted by first passing their small end through the large aperture 18 and then into the small aperture 20. The position of the apertures 18, 20 results in the gemstones 22 being set in parallel spaced relation, with their tapering in the same direction in this embodiment. The gemstones 22 may be firmly secured within the apertures 18, 20 with a suitable adhesive, or a portion of the metal of the side walls 14 surrounding the apertures 18, 20 may be deformed about the end portions of the gemstones 22 to firmly grip the gemstones 22. Subsequently, the end faces of the gemstones 22 are lapped and polished so that they are flush with the outer surface of the side walls 14.

Referring now to FIGS. 8–11, an alternate embodiment of a ring of the invention is illustrated. The elements of this embodiment are substantially identical to the elements of the previous embodiment except as otherwise indicated. Each of the sidewalls **14*a* has a multiplicity of both large apertures 18*a* and small apertures 20*a*, arranged in alternating sequence. The apertures 18*a*, 20*a* are arranged such that a large aperture 18*a* in one sidewall 14*a* opposes a small aperture 20*a* in the other sidewall 14*a*. The gemstones 20*a* are mounted, secured, lapped and polished as discussed above, but in this embodiment, the positioning of the apertures 18*a*, 20*a* results in the gemstones 20*a*** being set with their tapers in alternate directions.

Referring next to FIGS. 12–17, still another alternate embodiment of a ring of the invention is illustrated. The elements of this embodiment are again substantially identical except as otherwise indicated. The gemstones 24 in this embodiment are cylindrical. Each of the side walls **14*b* has a multiplicity of single sized apertures 26, aligned with the apertures 26 in the other side wall 14*b*. The gemstones 24 are mounted by inserting either end into an aperture 26 of one side wall 14*b* and then into the opposing aperture 26 of the other side wall 14*b*. The gemstones 24** are secured, lapped and polished as discussed above.

Referring lastly to FIGS. 18–21, a further embodiment of a ring has a metallic finding generally designated by the numeral **10*c* with a recess generally designated by the numeral 34 in which is disposed a multiplicity of cylindrical gemstones 42**.

As best seen in FIG. 18, the recess 34 has a pair of side walls 36 and a base wall 38. At one end of the recess 34, the side walls 36 arc outwardly as indicated by the numeral 37 to provide a recess 39 to seat a setting 30 of generally circular cross section which mounts a large gemstone 28. Each of the side walls 36 has a multiplicity of apertures 40, opposing the apertures 40 in the other sidewall 36.

The gemstones 42 are mounted as in the previous embodiment. The setting 30 for the large gemstone 28 may be secured in the recess 39 by deforming the side walls 36 thereabout, by a suitable adhesive, or solder, or a combination thereof. After placement of the large gemstone 28 in the setting 30, the setting 30 is deformed about the large gemstone 28 to secure it in the setting 30.

The finding may be cast or forged with the desired recess formed therein, or a recess of the appropriate shape may be cut into a casting or forging by use of a grinding or other cutting tool.

The small cylindrical gemstones may have a diameter of up to 2.2 mm and, preferably, the diameter is within the range of 1.5–1.8 mm. The length should be at least twice the diameter, and preferably at least 2.5 times the diameter in order to provide the desired appearance. The length will therefore typically extend up to approximately 7.0 mm. Typical dimensions for the conical gemstone include a diameter at the large end of 2.5 mm, a diameter at the small end of 1.0 mm, and a length of up to 7.0 mm. All of these dimensions may be varied considerably to obtain the desired effect.

The gemstones are conveniently produced by using a hollow core drill of the desired internal size and configuration. After extracting the gemstones from the core of the drill, they are highly polished by conventional techniques.

Various types of stones may be employed including amethyst, tourmaline, garnet, citrine, aquamarine, ruby, sapphire, and the like, or even synthetic stones, all of which can be utilized to produce the cylindrical or conical shapes.

Because each of the rod-like gemstones is exposed along most of its length and at its ends, light rays are reflected and refracted over substantially all of its surface. Moreover, light may enter along the length or into the ends to effect the illumination through the length and out the ends. As light rays exit the end faces of the gemstones, the appearance of the particular gemstone color is created along the sides of the finding.

As will be appreciated, different gemstones may be used in the given recess to provide multiple colors or variations within the grouping. Moreover, a single finding may have more than one recess containing such gemstones, and the gemstones in one recess may be oriented at an angle to the gemstones in another recess in the same finding. The ability to set the small rod-like gemstones in spaced relationship, as opposed to only an abutting relationship, affords numerous options for the desired aesthetic effect. Thus, the jewelry designer is given substantial opportunity and flexibility for producing jewelry items of a unique appearance. In any of the designs of the present invention employing the rod-like gemstones, it will be appreciated that the small rod-like shape is one yielding a soft appearance to the jewelry item, in contrast with the geometric appearance generated by use of conventional baguettes.

Thus, it can be seen from the foregoing detailed specification and attached drawings that the jewelry of the present invention permits light to be transmitted through its gemstones as well as reflected by them. The novel mounting permits gemstones to be firmly mounted in spaced relationship, and the jewelry item may be fabricated readily. The method for making jewelry items of the invention using small rod-like gemstones lends itself to wide variation in the nature of the findings and the appearance of the ultimate jewelry items.

Having thus described the invention, what is claimed is:

1. An article of jewelry including:

(a) a metal finding having an outer surface with at least one recess therein bounded in part by side walls extending along opposite sides of said finding, each of said side walls having a plurality of apertures therein aligned with the apertures of the opposite side wall; and (b) a plurality of elongated rod-like gemstones disposed in said recess with their end portions firmly seated in said apertures to retain said gemstones securely within said finding, said gemstones and apertures being cooperatively configured and dimensioned to expose at least a portion of at least one end face of said gemstones, said exposed end faces of said gemstones being essentially flush with the outer surface of the adjacent side walls, said gemstones having a width of not more than 2.2 mm.

2. The article of jewelry in accordance with claim 1 wherein said gemstones are of a generally cylindrical configuration.

3. The article of jewelry in accordance with claim 2 wherein said cylindrical gemstones have a diameter of not more than 2.2 mm and a length to diameter ratio of at least 2:1.

4. The article of jewelry in accordance with claim 1 wherein said metal finding is a ring having said recess extending about a portion of its circumference.

5. The article of jewelry in accordance with claim 1 wherein said gemstones and apertures are cooperatively configured and dimensioned to expose at least a portion of both end faces of said gemstones.

6. The article of jewelry in accordance with claim 1 including bonding means in said apertures to retain said gemstone securely within said recess.

7. A method for making jewelry (a) forming a metallic jewelry finding with an outer surface having at least one recess therein bounded in part by side walls extending along opposite sides of said finding, each of said side walls having at least one aperture therein;

(b) inserting through one of said apertures an elongated rod-like gemstone which extends across said recess and seating its end portions in said apertures;

(c) securing the end portions of said rod-like gemstone in said apertures so as to expose at least portion of at least one end face of said gemstone at side of said fitting; and (d) deforming a portion of said sidewalls adjacent said apertures to firmly engage said gemstone therein.

8. An article of jewelry including:

(a) a metal finding having an outer surface with at least one recess therein bounded in part by side walls extending along opposite sides of said finding, each of said side walls having a plurality of apertures therein aligned with the apertures in the other of said sidewalls; and (b) a plurality of elongated rod-like gemstones disposed in said recess with their end portions firmly seated in said apertures to retain said gemstones securely within said finding, said gemstones and apertures being cooperatively configured and dimensioned to expose at least a portion of both end faces of each of said gemstones, said exposed end faces of said gemstones being essentially flush with the outer surface of the adjacent side walls, said gemstones having a width of not more than 2.2 mm.

9. The article of jewelry in accordance with claim 8 wherein said gemstones are of a generally cylindrical configuration and have a diameter of not more than 2.2 mm and a length to diameter ratio of at least 2:1.

10. The article of jewelry in accordance with claim 8 wherein said metal finding is a ring having said recess extending about a portion of its circumference.

11. The article of jewelry in accordance with claim 8 including bonding means in said apertures to retain said gemstones securely within said recess.

12. In a method for making jewelry, the steps comprising:

(a) forming a metallic jewelry finding with an outer surface having at least one recess therein bounded in part by side walls extending along opposite sides of said finding, each of said side walls having a plurality of apertures therein;

(b) inserting through said apertures in one of said side walls a plurality of elongated rod-like gemstones which extend across said recess and seating their end portions in said apertures of the other of said side walls; and (c) securing the end portions of said rod-like gemstones in said apertures so as to expose at least a portion of at least one end face of said gemstones in one side wall of said finding, said one end face being substantially flush with the outer surface of the side wall at said one side of said finding.

13. The method for making jewelry in accordance with claim 12 wherein said securing step includes the step of placing a bonding agent in said apertures to secure said gemstone in said apertures.

14. The method for making jewelry in accordance with claim 12 wherein said forming step comprises forming a ring having said recess extending about a portion of its circumference.

15. The method for making jewelry in accordance with claim 12 wherein the securing step involves said gemstone and apertures being cooperatively configured and dimensioned to expose at least a portion of both end faces of said gemstone.

16. A method for making jewelry (a) forming a metallic jewelry finding with an outer surface having at least one recess therein bounded in part by side walls extending along opposite sides of said finding, each of said side walls having at least one aperture therein;

(b) inserting through one of said apertures an elongated rod-like gemstone which extends across said recess and seating its end portions in said apertures;

(c) securing the end portions of said rod-like gemstone in said apertures so as to expose at least a portion of at least one end face of said gemstone at one side of said fitting; and (d) grinding portions of said gemstone projecting beyond the outer surfaces of said side walls to render said end faces flush with said outer surfaces.

17. The method for making jewelry in accordance with claim 16 wherein said forming step provides each of said side walls with a plurality of apertures aligned with the apertures in the other of said side walls, and wherein said inserting and securing steps involve inserting and securing a plurality of gemstones in said apertures.

* * * * *